United States Patent [19]

Brignoli

[11] Patent Number: 4,794,738

[45] Date of Patent: Jan. 3, 1989

[54] KNIFE SHEATH INCORPORATING SHARPENING MEANS FOR THE BLADE

[76] Inventor: Giovanni Brignoli, Via L. da Vinci, 11, 24046 OSIO SOTTO (Bergamo), Italy

[21] Appl. No.: 31,605

[22] Filed: Mar. 30, 1987

[51] Int. Cl.[4] ..... B24B 3/54

[52] U.S. Cl. ..... 51/214; 51/354; 30/138; 76/82

[58] Field of Search ..... 30/138, 151; 51/214, 51/354; 76/86, 87, 82, 82.2, 88; 7/120

[56] References Cited

U.S. PATENT DOCUMENTS

| | | | |
|---|---|---|---|
| 2,441,690 | 5/1948 | Dirksen | 51/354 |
| 2,767,530 | 10/1956 | Paldanius | 51/214 |
| 3,676,961 | 7/1972 | Jackson | 30/138 X |
| 4,091,691 | 5/1978 | Bayly | 30/138 X |
| 4,669,337 | 6/1987 | Petroff | 51/214 X |
| 4,718,200 | 1/1988 | Miquelot | 30/138 X |

*Primary Examiner*—Frank T. Yost
*Assistant Examiner*—Michael D. Folkerts
*Attorney, Agent, or Firm*—Shlesinger, Fitzsimmons & Shlesinger

[57] ABSTRACT

A knife sheath contains a sharpening device which functions to sharpen a knife's blade at the introduction and extraction of the knife into and out of, respectively, the sheath. The device is incoporated in the form of a separate subassembly that is removably inserted into one end of a knife sheath.

4 Claims, 2 Drawing Sheets

KNIFE SHEATH INCORPORATING SHARPENING MEANS FOR THE BLADE

The present invention concerns some interesting improvements in a knife sheath, of the type which incorporates sharpening means for the knife's blade, such means acting each time the knife is introduced into or extracted from the sheath itself.

Sheaths of this type are in general those for instance described and illustrated in French Pat. Nos. 2047405 and 2119676. In short, they consist of a case or sheath of an oblong shape inside of which are mounted sharpening means through which the blade is guided compulsorily to pass at every translation movement (introduction and/or extraction) with respect to the sheath.

However, the sheaths of the known type suffer of the drawback of being rather expensive, due to their structural and assemblage complexity.

Thus, the main object of the present invention is that of overcoming the above cited drawback, by realizing a sheath that may be extremely simple to produce and assemble and, therefore, economical in costs.

For this purpose, according to the invention, it was conceived to devise a knife sheath of the type incorporating sharpening means for the knife's blade, such means acting on the blade each time at the introduction and extraction of the knife itself, and characterized in that said sharpening means are incorporated in the form of a sharpening dedevice shaped and structured as a separate subassembly that is applied to one end of the sheath.

The structural and functional characteristics of the invention as well as the advantages of the same, in comparison with those of the Prior Art, will be more clearly evidenced by a close examination of the following description, with reference to the attached drawings, which illustrate an example of a sheath realized according to the innovating principles of the invention itself. In the drawings.

Figure 2:
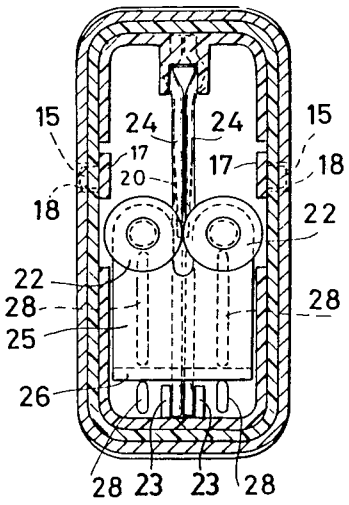
FIG. 2 is a cross-sectional view according to section line II—II of FIG. 1.
Figure 1:
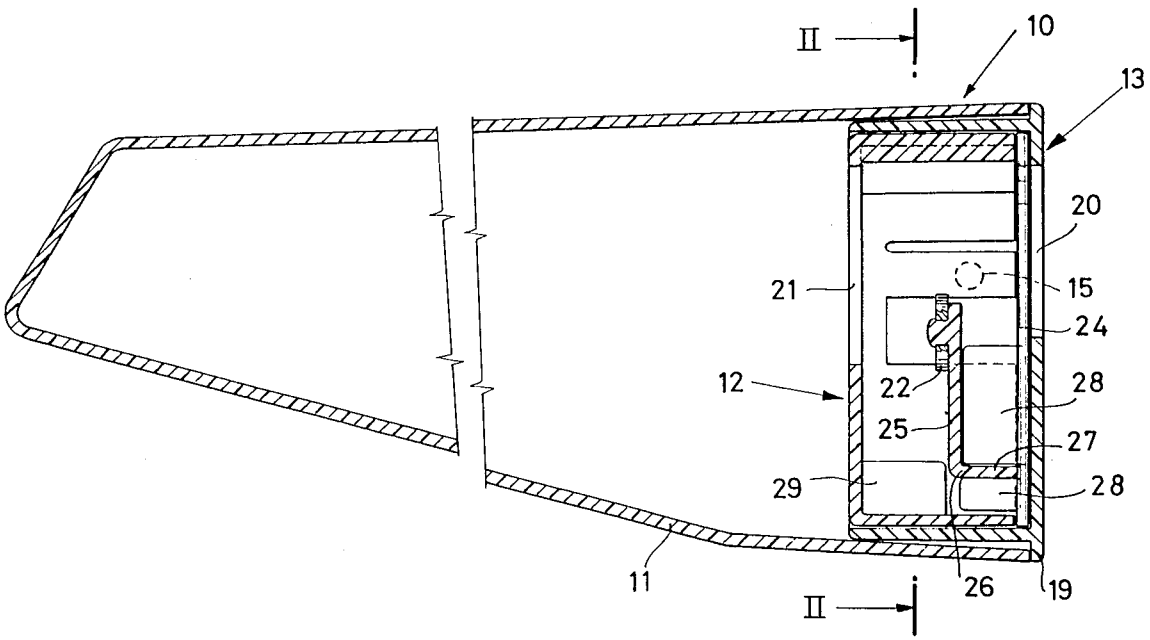
FIG. 1 represents a longitudinal cross-sectional view of the assembled sheath.
Figure 3:
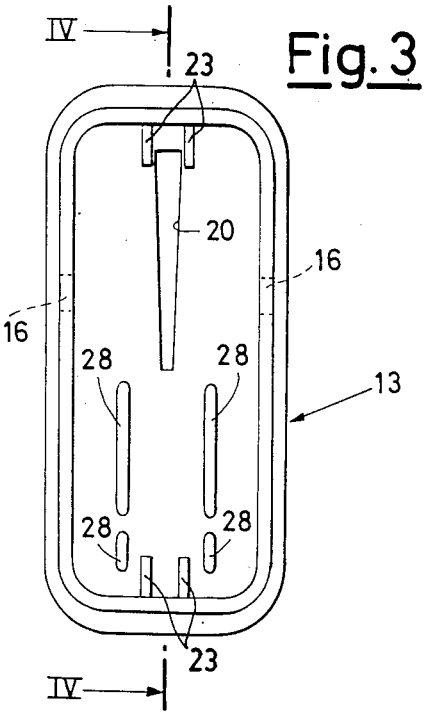
FIG. 3 is a front view in elevation of the outer semi-shell of the sharpening device incorporated in said sheath, taken according the sense indicated by arrow F of FIG. 4.
Figure 4:
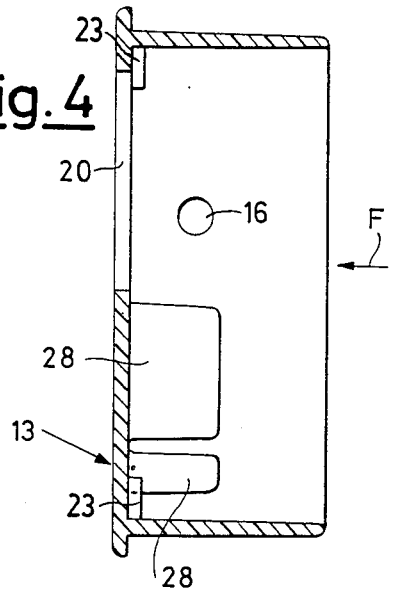
FIG. 4 represents a lateral vertical cross-section taken along section line IV—IV of FIG. 3.
Figure 5:
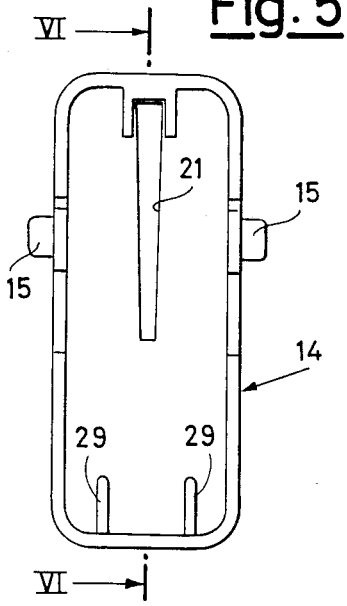
FIG. 5 is a vertical front cross-section of the inner semi-shell of the sharpening device incorporated in said knife sheath, taken in the sense pointed by arrow F1 of FIG. 6.
Figure 6:
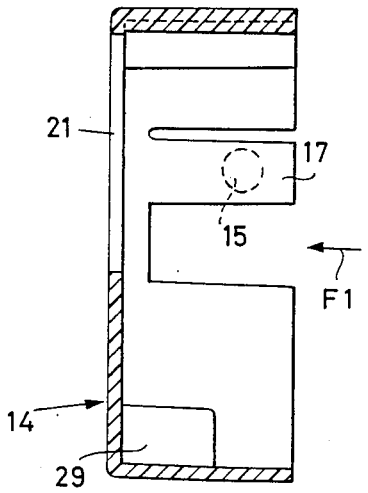
FIG. 6 is a vertical side view cross-section of the inner semi-shell, taken alon section line VI—VI of FIG. 5.

With reference to said drawings, the sheath in question is indicated generally by 10, and is structurally formed by a case 11 of an oblong and preferably tapered shape, this case being closed at its narrower end, while the other end is fitted with the blade-sharpening device 12, through which the knife is inserted into the sheath.

Said device 12 is characterized in that it is formed by a subassembly which is realized and assembled as an independent unit in a way completely separated from case 11, to which the device 12 itself is applied with a snap-lock fit by simple insertion, as will be described in detail further on.

Device 12 consists of a box-like body formed by two semi-shells or generally cup-shaped members 13,14 which form, respectively, an outer and an inner shell. The semi-shells are inserted one into the other and intercoupled by a releasable snap-lock consisting of a pair of lateral pins or plugs 15 carried on inner semi-shell 14 to engage in registering holes 16 of the outer semi-shell 13. In order to allow a snap-lock action, pins 15 are respectively carried on elastically yielding tongue portions 17 of member 14.

Characteristically, the same pins 15 serve also for the releasable locking into place of device 12 into case 11. In fact, at the moment of insertion of device 12 into case 11, pins 15 engage corresponding holes 18 provided in the sides of case 11 itself.

A peripheral flange 19, obtained on the external semi-shell 13, abuts against the edge of the end of case 11.

Moreover, semi-shells 13 and 14 respectively show corresponding aligned slots 20, 21, through which passes the knife's blade (not shown in the drawing).

Inside semi-shell 13 are sharpening means for the knife's blade. Said means, as shown in the example, comprises a pair of confronting discs 22, made of a suitable material and between which the blade itself is guided in its passage by a pair of coupling elements mounted immediately inwardly or downstream of slots 20.

Said coupling elements consist of a pair of adjacent metal bars 24 that extend at opposite ends beneath the inner end of member 14, and between two pairs of projections 23 formed on the bottom member 13. Bars 24 are relatively elastically yielding, and are positioned so that the knife is forced to pass between them when introduced into slot 20.

The sharpening discs 22 are mounted on one leg 25 of a generally L-shaped support having its other leg forming a base 26 that is removably inserted into slots 27 cut through a pair of supporting ribs 28 which protrude from semi-shell 13 so as to engage the back of support leg 25. As can clearly be seen from the drawings, said support 25, 26 is in its turn maintained permanently in place by a locking action exerted by a pair of ribs 29 protruding from semi-shell 14.

It thus appears quite evident how device 12, complete of the sharpening means, may be realized as a separate subassembly which is then easily and simply inserted on case 11.

What is claimed is:

1. A knife sheath of the type open at one end and containing sharpening means for a knife's blade, said means acting to sharpen said blade at the introduction of the knife into and extraction of the knife from said sheath, said sharpening means being part of a separate subassembly removably inserted into said one end of the knife sheath and comprising a first, generally shell-shaped member having a closed end releasably positioned across and substantially closing said one end of said sheath, and having an open end projecting axially toward the opposite end of said sheath, a second, generally shell-shaped member having a closed end spaced from the closed end of said first member and positioned across and substantially closing the open end of said first member, and having an open and extending axially toward said first member, said closed ends of said members having therein registering slots for guiding the blade of a knife into said sheath, and means on said members removably supporting said sharpening means in the path of travel of said blade during the introduction and retraction thereof relative to said sheath, said open ends of said shell-shaped members being nested one within the other, and said sub-assembly further including means releasably coupling the open, nested ends of said members to each other and to said knife sheath.

2. A knife sheath according to claim 1, characterized in that said coupling means comprises a pair of pins protruding resiliently from opposite sides of the inner of said nested ends of said members and passing through registering holes in the outer of said nested ends and in the sheath.

3. A knife sheath according to claim 1, characterized in that said sharpening means comprises a pair of adjacent, coplanar discs, and a pair of metal bars mounted in said first member adjacent opposite sides of the slot in said closed end thereof to be elastically yielding with respect to each other, and, positioned to guide a knife blade between said discs when the blade is introduced into the sheath.

4. A sheath according to claim 3, characterized in that said means supporting said sharpening means comprises a bracket having thereon a first leg supporting said discs, and a second leg releasably locked into place by projections on said members.

* * * * *